US005961271A

United States Patent [19]

Theurer et al.

[11] Patent Number: 5,961,271

[45] Date of Patent: Oct. 5, 1999

[54] CARS FOR REMOVING LONG RAILS STORED ON TRANSPORT CARS

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 09/005,878

[22] Filed: Jan. 12, 1998

[30] Foreign Application Priority Data

Jan. 10, 1997 [AU] Australia ..... A 30/97

[51] Int. Cl.[6] ..... E01B 29/02

[52] U.S. Cl. ..... 414/339; 104/2; 414/745.4; 414/746.7

[58] Field of Search ..... 414/339, 501, 414/502, 745.4, 745.5, 745.7, 800, 746.7; 104/2, 5

[56] References Cited

U.S. PATENT DOCUMENTS

| | | | |
|---|---|---|---|
| 3,330,219 | 7/1967 | Plasser et al. | 104/2 |
| 3,557,703 | 1/1971 | Moorfield | 104/2 |
| 4,028,903 | 6/1977 | Dietrich | 414/800 |
| 4,076,130 | 2/1978 | Sumner | 414/745.4 |
| 4,270,456 | 6/1981 | Theurer et al. | 104/2 |
| 4,911,599 | 3/1990 | Theurer et al. | 414/339 |
| 4,923,355 | 5/1990 | Mancini | 104/2 |

FOREIGN PATENT DOCUMENTS

| | | |
|---|---|---|
| 0467001 | 9/1993 | European Pat. Off. . |
| 2734748 | 8/1980 | Germany . |
| 1208326 | 7/1996 | Germany . |

*Primary Examiner*—Christopher P. Ellis
*Assistant Examiner*—Isobel A. Parker
*Attorney, Agent, or Firm*—Horst M. Kasper

[57] ABSTRACT

A rail-movable car (1) for removing and pulling out long rails (3), stored on a transport car (2), includes a car frame (6), supported on an undercarriage (5) guided on rails, and a rail-removing device (4) for gripping and shifting a long rail (3) in the longitudinal direction of the car. The rail-removing device (4) includes a crawler (7), wherein the crawler is furnished with a first drive (11) and is deflectable around two deflection rollers (9), disposed at a distance from each other and exhibiting a rotation axis (10), contact plates (15) disposed in series in the removal direction for engaging and resting at the long rail, and a counter support (8) adjustable by means of a second drive (23) relative to the crawler, and wherein the counter support (8) is adapted to roll off on the long rail (3).

16 Claims, 3 Drawing Sheets

Fig. 3
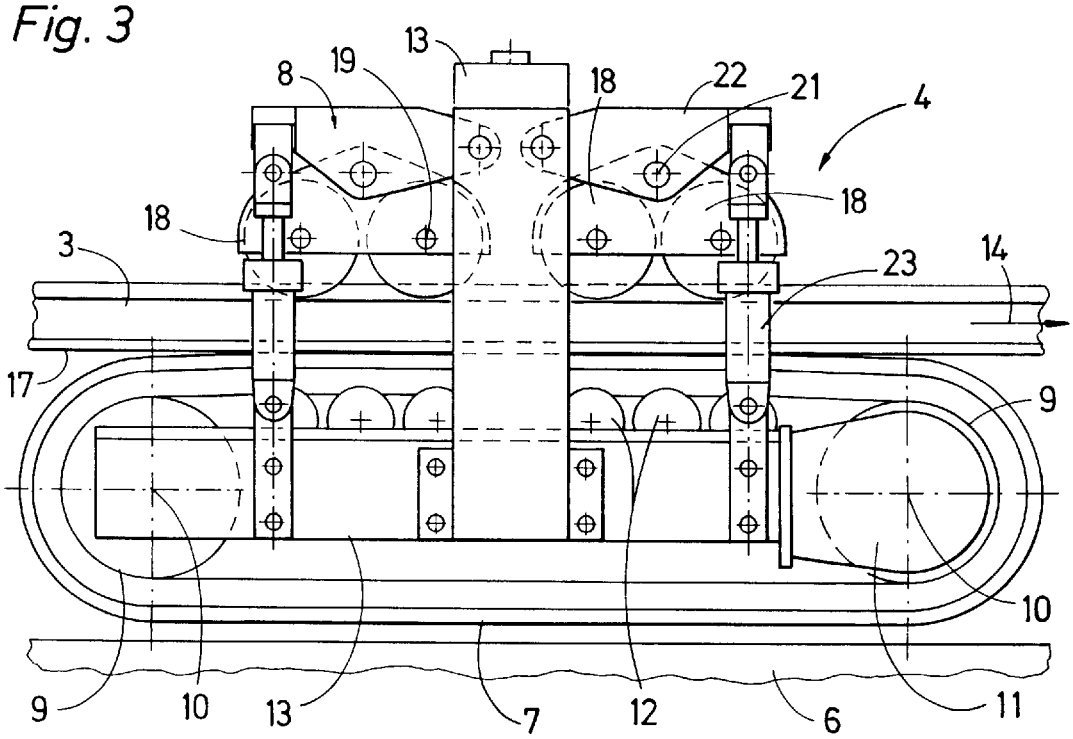
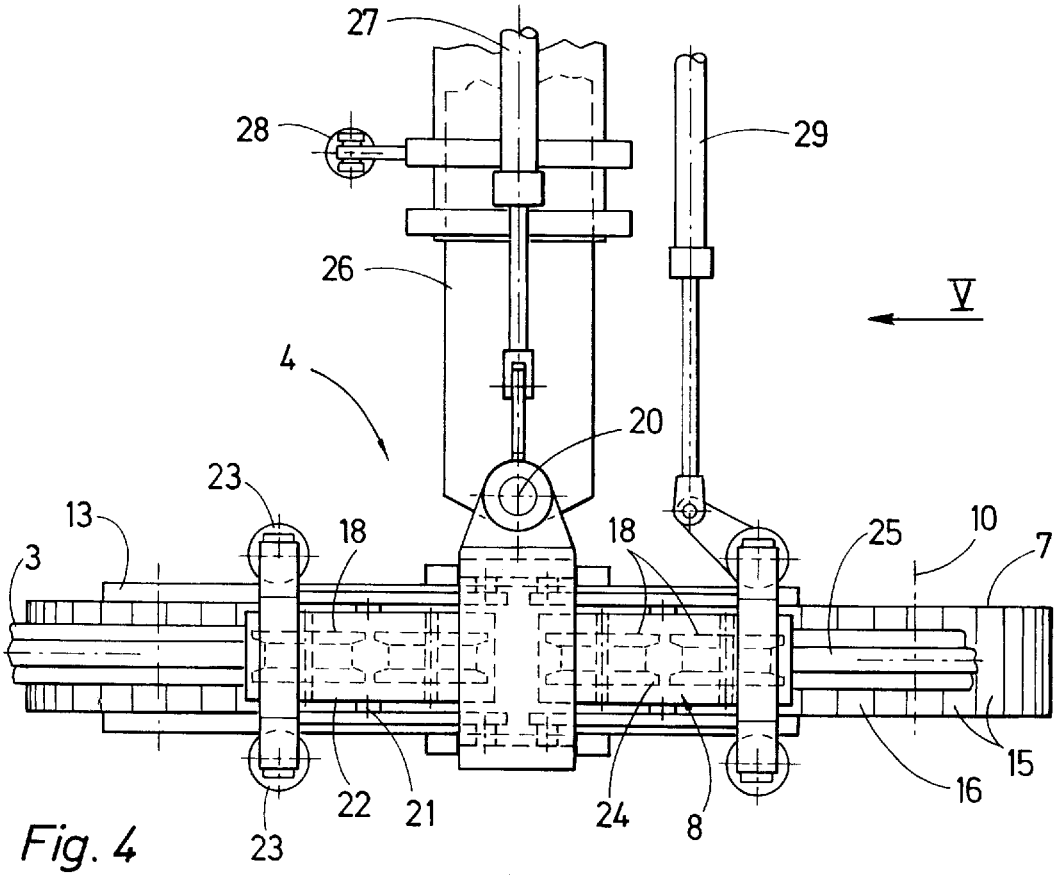
Fig. 4

Fig. 5
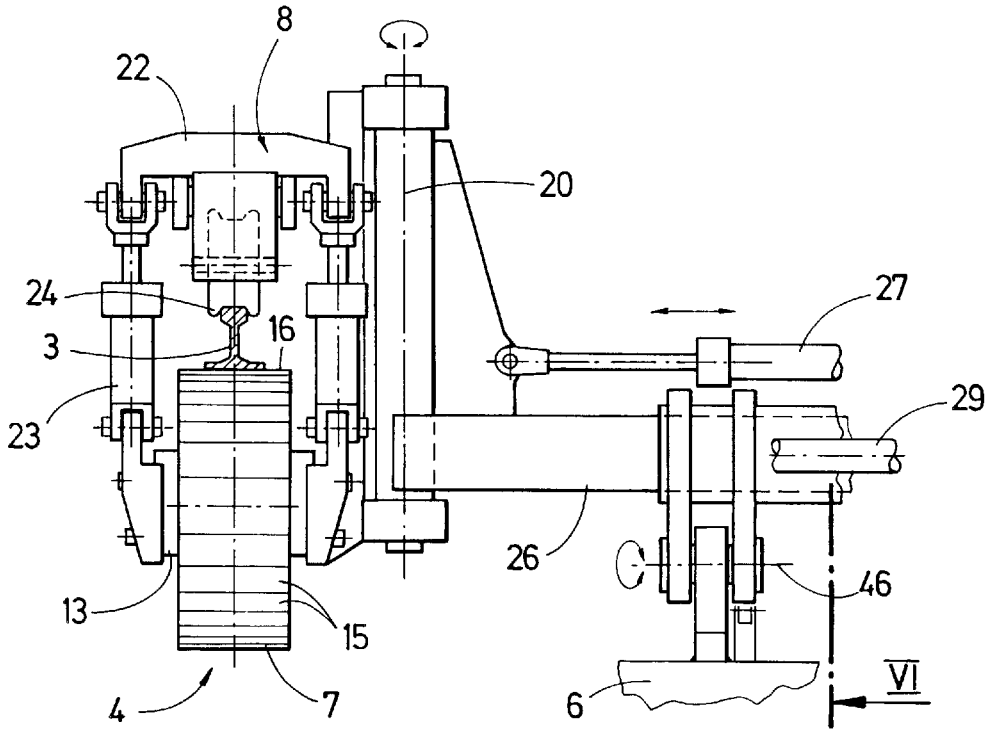
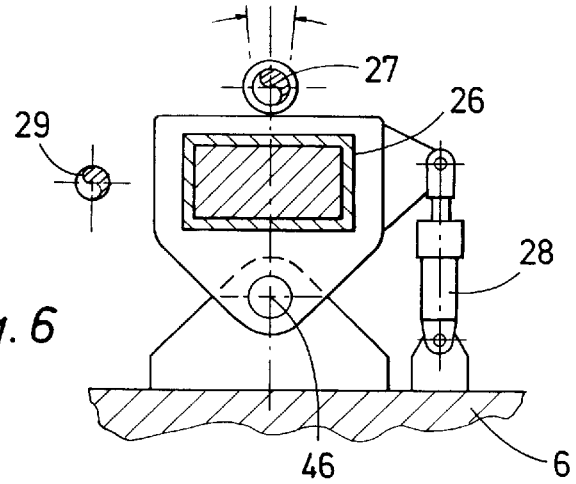
Fig. 6
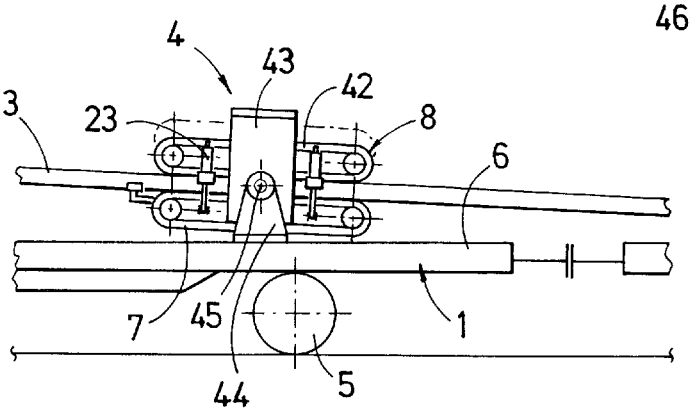
Fig. 7

CARS FOR REMOVING LONG RAILS STORED ON TRANSPORT CARS

BACKGROUND OF THE INVENTION

1. Field of the Invention

The invention relates to a rail-guided vehicle for removing and laying long rails supported on transport vehicles, with a vehicle frame supported on undercarriages, running on rails, and a rail removal device for gripping and shifting a long rail in a longitudinal direction of the rail-guided vehicle.

2. Brief Description of the Background of the Invention Including Prior Art

Vehicles for removing and pulling off long rails supported on transport cars of the above-recited kind are known. Such a rail-removing and pull-out car or vehicle is known from the European printed patent document EP 0 467 001 B1, wherein a rail-removing and pull out device is constructed similar to a crane jib with guide rollers and a rail tong. This tong, formed for gripping and capturing the long rail to be removed and pulled is longitudinally shiftable in the removal direction with a drive. The long rail is shifted stepwise toward a removing device by repeatedly gripping with the rail tong as well as repeatedly moving back the rail-removing device. A further shifting of the rail strand in the direction toward the front end of the rail-laying train is performed with the rail-removing device. The known rail-removing device is not very efficient and requires in particular a low-friction support and prop of the long rails on rollers in order to minimize thereby the resistance to being removed.

Rail loading trains are known from the German printed patent documents DE 1,208,326 B or, respectively, DE 27 34 748 B, which are formed by a plurality of rail transport cars coupled to each other. For storing the long rails to be transported, there are known rail support seats attached at the vehicle frame and spaced apart from each other in the longitudinal direction of the vehicle or, respectively, of the train, with support rollers, disposed sequentially in crosswise direction to the vehicle. The vehicle, furnished at the end of the train for removing and pulling off the long welded rails, also designated as glide vehicle, exhibits, just as the adjoining rail transport vehicles, crane rails for guiding and moving a rail-loading crane, wherein the crane rails extend in the region of each longitudinal side in the longitudinal direction of the car. This rail-loading crane is movable based on a portal-frame-like construction over the stored long rails, and the rail-loading crane can grip with the aid of two crane jibs in each case two long rails and can shift the long rails in the direction toward the glide vehicle. The long rails are guided in this end region by way of rollers and are sequentially shifted up to ground contact and finally anchored to the track. The further removing and pulling out of the two long rails is performed by advancing the rail-loading train.

The European Patent publication number 0 467 001 B1 issued Sep. 29, 1993 to Fritz Buhler teaches a train for laying new railway tracks. A transport wagon, a device for laying sleepers, and a rail-laying device are combined. The devices for laying sleepers and the device for rail-laying are disposed and installed on a laying wagon, wherein the laying wagon is disposed between a transport wagon for rails and a handling wagon. Tracked bogies for rail transport are articulated with each other.

SUMMARY OF THE INVENTION

1. Purposes of the Invention

It is an object of the present invention to furnish a rail-movable car of the kind recited which allows to remove and pull out particularly long rails without problems, even though the rails are not pre-positioned on rollers.

This and other objects and advantages of the present invention will become evident from the description which follows.

2. Brief Description of the Invention

According to the invention, this object is accomplished with a car of the kind recited such that the rail-removing and pulling-out device is formed of a crawler, furnished with a drive and deflectable around two deflection rollers, said deflection rollers disposed at a distance from each other and including a rotation axis, wherein the crawler includes contact plates, disposed in-series in removal direction for resting at the long rail as well as of a counter support, which counter support can be adjusted with a drive relative to the crawler and which counter support can be rolled off on the long rail.

A particularly high removal force is available based on this tong-like acting rail-removing device such that for example also 120-meter-long rails can be removed and pulled out without any problem. Based on a correspondingly long construction of the crawler, the removing forces are to be increased such that also long rails can be removed, which long rails are only supported on intermediate layers and therefore necessarily oppose a shifting with a particularly high friction resistance. The contact plates preferably to be formed at least having the width of the rail foot or rail base allow a maximum contact surface or, respectively, press-on surface, wherein a damage of the long rail can be reliably excluded even in case of particularly high press-on forces of about 32 tons. A further particular advantage of the rail-removing and pull-out device is also associated therewith that the removing and pulling out can be performed continuously such that also a railway sleeper can be continuously placed as well as a laying of the removed long rails onto the placed railway sleepers can be performed parallel to the rail withdrawal in connection with a track-laying machine connected to the car or vehicle.

According to the present invention, there is provided for a rail-movable vehicle for removing long rails stored on a transport vehicle. The rail-movable vehicle includes undercarriages guided by rails. A vehicle frame is supported on the undercarriages guided by rails. Two deflection rollers are mounted on the vehicle frame. The two deflection rollers are disposed at a distance from each other and a rotation axis is associated with each deflection roller. A crawler is attached to the vehicle frame. The crawler is deflectable around two deflection rollers. A drive is attached to the vehicle frame. The crawler is attached to the drive. Contact plates are attached to the crawler and disposed in series in a removal direction for engaging with and for resting at the long rail. A second drive is attached to the frame. A counter support, adjustable by means of the second drive, is adjustably positioned relative to the crawler. The counter support is adapted to roll off on the long rail. The deflection rollers, the crawler, the contact plates, the second drive, and the counter support form a rail-removing device for capturing, gripping, and shifting a long rail in a longitudinal direction of the rail-movable vehicle carrying the rail-removing device.

The rail-removing device can be attached to the vehicle frame swivelable around a vertical axis.

The counter support can be formed by at least two double-track rim rollers, disposed in series in the removal direction. The double-track rim rollers can have respective axes aligned parallel to the rotation axis of the deflection rollers. The counter support can be positioned vertically above the crawler.

Four double-track rim rollers can be placed centered between the two rotation axes of the deflection rollers as seen in a vertical projection.

A support can be attached to the vehicle frame. The rail-removing device can be attached to the support. The support can be formed extendible horizontally and perpendicular to the longitudinal direction of the vehicle carrying the rail-removing device for adjusting a lateral position of the rail-removing device.

A fourth swivel drive can be attached to the frame. The support can be supported swivelable around a horizontal axle supported at the vehicle frame and aligned perpendicular to the longitudinal direction of the vehicle carrying the rail-removing device. The support can be connected to the fourth swivel drive for swivelling the support around said horizontal axle.

A hoisting winch can be disposed at an end of the rail-movable vehicle carrying the rail-removing device for feeding a long-rail. A sixth drive can be attached to the vehicle frame. A guide roller can be height-adjustable by the sixth drive for supporting the long rail.

The first rail-removing device and a second rail-removing device can be independent from each other and can be disposed at an end of the rail-movable vehicle carrying the rail-removing device located remote relative to the hoisting winch.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention:

FIG. 3 is an enlarged side elevational view of a rail-removing device;

FIG. 4 is a top plan view of the rail-removing device shown in FIG. 3;

FIG. 5 is a side elevational view of the rail-removing device according to the arrow 5 shown in FIG. 4;

FIG. 6 is a simplified cross-sectional view along the section line 6 shown in FIG. 5; and FIG. 7 is a side elevational view of a further embodiment of the rail-removing device.

DESCRIPTION OF INVENTION AND PREFERRED EMBODIMENT

Figure 1:
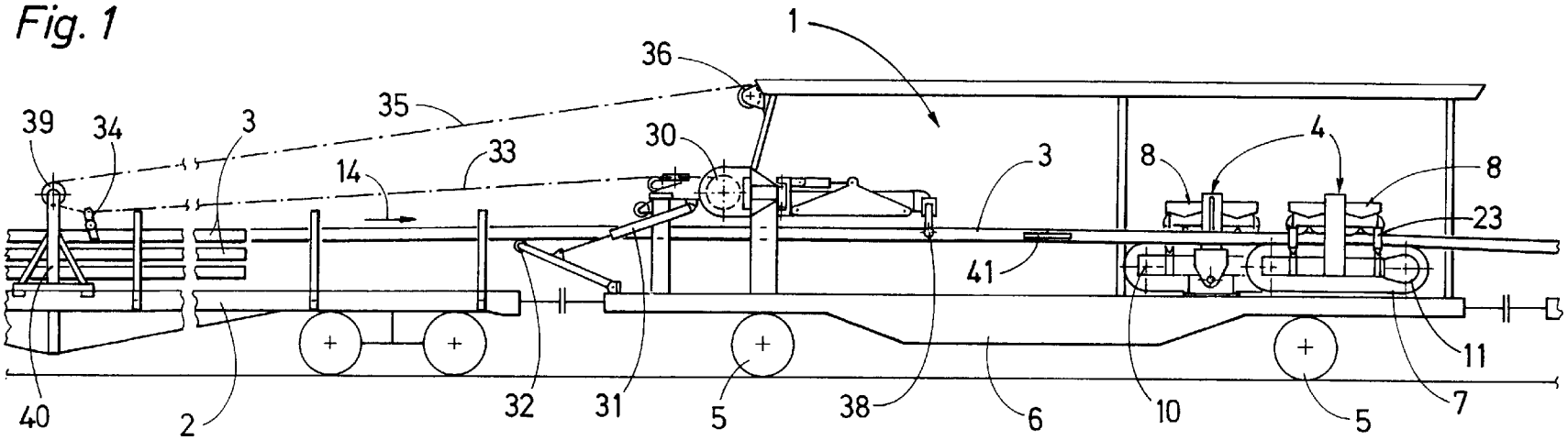
FIG. 1 is a side elevational view of a rail-movable car for removing long rails stored on transport cars.

The present invention provides for a rail-movable car 1 for removing long rails 3, stored on a transport car 2 and comprising a car frame 6, supported on undercarriages 5 guided by rails, and a rail-removing device 4 for capturing, gripping, and shifting a long rail 3 in a longitudinal direction of the car. The rail-removing device 4 is formed of a crawler 7. The crawler is furnished with a first drive 11. The crawler is deflectable around two deflection rollers 9. The two deflection rollers 9 are disposed at a distance from each other. A rotation axis 10 is associated with each deflection roller 9. Contact plates 15 are disposed in series in the removal direction for engaging with and for resting at the long rail. A counter support 8 is adjustable by means of a second drive 23 relative to the crawler. The counter support 8 is adapted to roll the long rail 3 off.

The rail-removing device 4 can be attached to the car frame 6 swivelable around a vertical axis 20.

The counter support 8 can be formed by at least two double-track rim rollers 18. Said two double-track rim rollers 18 can be disposed in series in the removal direction. The double-track rim rollers 18 can have respective axes 19 aligned parallel to the rotation axis 10. The counter support 8 can be positioned vertically above the crawler 7.

Four double-track rim rollers 18 can be placed centered between the two rotation axes 10 of the crawler 7 as seen in a vertical projection.

The rail-removing device 4 can be attached to a support 26. The support 26 can be formed extendible horizontally and perpendicular to the longitudinal direction of the car for adjusting a lateral position of the rail-removing device 4. The support 26 can be attached at the car frame 6.

The support 26 can be supported swivelable around a horizontal axis 46 aligned perpendicular to a longitudinal direction of the car at the car frame 6. The support 26 can be connected to a fourth swivel drive 28 for swivelling the support 26 around the horizontal axis 46.

A hoisting winch 30 and a guide roller 32 can be disposed at an end of the car for feeding new long rails 3. The guide roller 32 can be height-adjustable by a sixth drive 31 for supporting the long rail 3.

Two rail-removing devices 4, independent from each other, can be disposed at an end of the car disposed remote relative to the hoisting winch 30.

Figure 2:
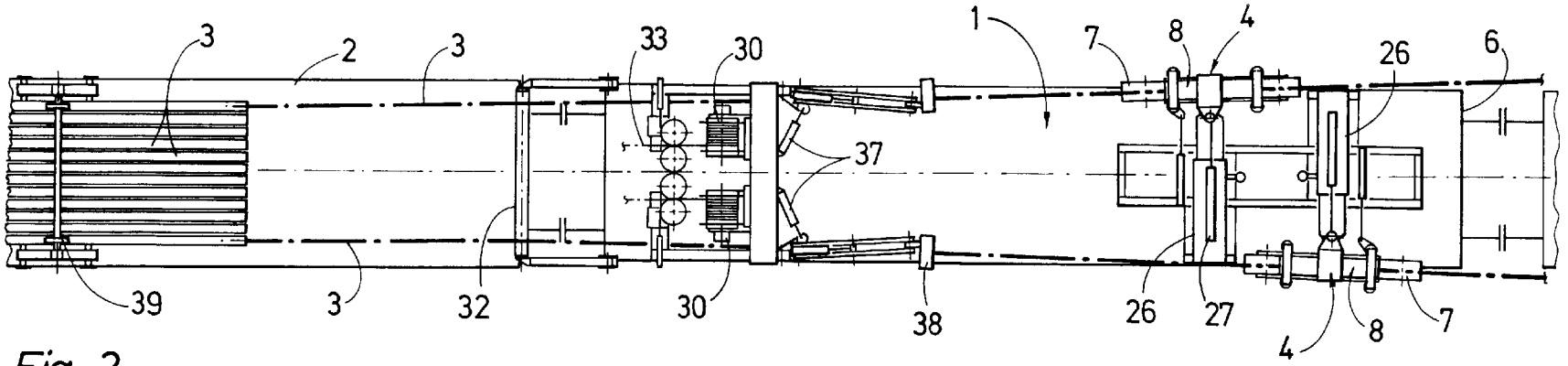
FIG. 2 is a top plan view of the rail-movable car shown in FIG. 1.

A car illustrated in FIGS. 1 and 2 for removing and pulling off long rails 3, stored on transport cars 2, is furnished with two rail-removing devices 4, operating independently from each other, for gripping and for shifting the long rails 3. The rail-removing devices 4 are attached to a car frame 6 supported on undercarriages 5 guided on rails, wherein the car frame 6 forms together with the neighboring transport car 2 a rail-laying train, not illustrated in detail, for the continuous laying of a new track formed by the long rails 3 and new sleepers.

The two rail-removing devices 4 are disposed at a distance from each other in a cross-wise direction to the car and are formed in each case of a crawler 7, extending approximately in the longitudinal direction of the car, and of a counter support 8 disposed above the crawler 7. The two rail-removing devices 4 are swivelably supported both around a vertical axis 20 (FIGS. 4 and 5) and around an axis 46 (FIGS. 5 and 6), extending horizontally and perpendicular to the longitudinal extension of the rail-removing device.

The view of FIG. 3 is more or less an enlarged detail view of FIG. 1 and the view of FIG. 4 is more or less an enlarged detail view of FIG. 2.

The two rail-removing devices 4 according to FIG. 2 are disposed substantially around a two-fold rotation axis 120 aligned vertical and disposed at the middle of the width of the vehicle carrying the rail-removing devices 4 and in the middle between the two rail-removing devices 4 such that corresponding points of the two rail-removing devices 4 have substantially the same distance from the two-fold rotation axis 120. A rotation around a swivel axis 20 can be superposed to the recited symmetry around rotation axis 120. The swivel axis 20 is located at a plane perpendicular to the longitudinal direction of the rail removal vehicle at about the longitudinal middle of the four double-track rim rollers 18 and at a distance of from about 0.2 to 0.5 times the total longitudinal extension of the four double-track rim rollers 18 and preferably from about 0.25 to 0.4 times the total longitudinal extension of the four double-track rim rollers 18.

As can be recognized in particular in the enlarged detail views of the rail-removing device 4 according to FIGS. 3–6, the crawler 7 is an endless crawler which is supported on deflection rollers 9, disposed at a distance from each other in the longitudinal direction of the car, wherein the deflection rollers 9 in each case are rotatably supported around a rotation axis 10, extending horizontally and perpendicular to the longitudinal direction of the car. While the two crawlers 7, shown in FIG. 2, are disposed at a distance, their relative alignment to each other corresponds substantially to a rotation around the axis 120. One of the two deflection rollers 9, supported on a support frame 13, can be caused to rotate based on a first hydraulic drive 11. A plurality of smaller support rollers 12 for supporting the crawler 7 is disposed on the support frame 13 between the two deflection rollers 9. The crawler 7 is composed of a plurality of contact plates 15 (FIGS. 4, 5), hingedly connected to each other and disposed in series in the removal direction or, respectively, transport direction (according to arrow 14), wherein the contact plates 15 are only indicated in FIGS. 4 and 5 for clarity of the remaining drawings and for a better recognizability. The contact plates 15 are preferably rectangular-shaped and are hingedly connected to each other at their longer edges whereas their shorter edges run parallel relative to the longitudinal direction of the vehicle carrying the rail-removing devices 4. The extension of the contact plates 15 in a lateral direction of the car is preferably at least two times the extension of the contact plates in a longitudinal direction of the car. These contact plates 15 form in the upper part of the crawler 7 a rail-contact plane 16 (shown in particular in FIG. 5), wherein the rail-contact plane 16 runs parallel to a rail-foot plane 17 of the long rail to be removed. The rail contact planes 16 for the two rails being simultaneously removed can change their position independently from each other depending on the specific position of each one of the two rail-removing devices 4.

As is visible in particular in FIG. 3, the counter support 8 is formed by four double-track rim rollers 18, disposed in series in transport direction, with axes 19 running parallel to the rotation axis 10. The counter support 8 is disposed vertically above the crawler 7 and is capable of adjusting positions relative to and above the crawler 7. In each case two of the four double-track rim rollers 18 are swivelable around an axis 21 (FIGS. 3 and 4), running parallel to the axes 19 and to the axes 10. Each two of the four double-track rim rollers 18 are supported on a yoke 22, wherein the yoke 22 in turn is swivelably hinged at its first end 122 to the support frame 13. The yoke 22 is connected at its second end 124 to a second drive 23. The distance of the axes 10 of the two deflection rollers 9 from each other is preferably larger than the distance of the axes 19 of two outer rollers of the four double-track rim rollers 18 and is preferably at least about 1.2 times the distance of the axes 19 of two outer rollers of the four double-track rim rollers 18. The axes 19 of the four double-track rim rollers 18 are preferably disposed in a horizontally extending plane. The second drive 23 can be a hydraulic cylinder. As is in particular visible from FIG. 4, two second drives 23, disposed at a distance from each other in cross-wise direction to the car, are coordinated to each yoke 22 of the counter support 8, which second drives 23 are in each case attached with their lower ends at the support frame 13 of the rail-removing device 4. The counter support 8 and the yokes 22 are disposed substantially mirror-symmetrical to a plane disposed perpendicular to the longitudinal direction of the vehicle carrying the rail-removing device and located at the center of the support frame 13. The double-track rim rollers 18 exhibit in each case two wheel rims 24, disposed at a distance from each other in the direction of the axis 19, such that a rail head 25 of the long rail 3 can be centered in and between the respective wheel rims 24. In other words, the distance between the two wheel rims 24 of the double-track rim roller 18 corresponds to the width of the rail head 25.

The rail-removing device 4 is attached to a telescopic support 26 (FIG. 5), which telescopic support 26 is formed extendible in a horizontal direction perpendicular to the car longitudinal direction by being attached to and based on a third drive 27. The telescopic support 26 is attached to the car frame 6. In addition, the support 26 together with the rail-removing device 4 is swivelable around the axis 46, running horizontal and perpendicular to the longitudinal direction of the car, with the aid of a fourth swivel drive 28. The swivelling of the rail-removing device 4 around the vertical axis 20 relative to the support 26 is performed by a further, fifth swivel drive 29, shown in FIG. 4.

As can be recognized from FIGS. 1 and 2, two hoisting winches 30 as well as a guide roller 32, disposed horizontally and perpendicular to the longitudinal direction of the vehicle carrying the rail-removing device 4 and adjustable in its height by a sixth drive 31, are furnished at an end 101 of the car 1, neighboring to the transport car 2, for supporting the two longitudinal rails 3 to be removed. A load cable 33, wound on a hoisting winch 30, is provided at the end with a clamping hook 34 (FIG. 1) and is connected to a return cable 35. The return cable 35 can in each case be wound onto the hoisting winch 36 illustrated only in FIG. 1. Two rail guides 38, attached at the car frame 6, are disposed between the two hoisting winches 30 and the rail-removing device 4, as seen in longitudinal direction of the car, wherein the two rail guides 38 are adjustable in their height and lateral positions by seventh drives 37.

The removal of the long rail, stored on the transport car 2, with the two rail-removing devices 4 is described in more detail in the following.

The return cables 35 are wound up by hydraulic activation of the two hoist winches 36 and thereby simultaneously each clamping hook 34 is moved in the direction of the long rails 3 to be removed. For this purpose, the two hoisting winches 30 are switched to be pressureless. In order to be able to position the clamping hook 34 above the respective long rail 3 to be removed, the two deflection rollers 39, deflecting the return cables 35 are supported shiftable, in a horizontal direction perpendicular to the longitudinal direction of the vehicle carrying rail-removing device 4, on a support frame 40. After connecting each clamping hook 34, furnished with a quick-acting closure, to a long rail 3, the removal of the long rail 3 is performed in removal direction, illustrated by the arrow 14 (FIG. 1), as soon as the respective hoisting winch 30 is activated to wind up the load cable 33. Simultaneously, the coordinated hoist winch 36 is switched pressureless. As soon as the front end of the moved long rail 3 reaches the guide roller 32, the guide roller 32 is hoisted upon activation of the sixth drive 31 until the two long rails 3 are supported by the guide roller 32. After a further advance of the long rails 3, the front ends of the long rails 3 are gripped by tong-shaped formed rail guides 38 and are guided upon activation of the seventh drives 37 such that the two front ends come in each case to rest on the rail-contact plane 16 (FIG. 4) of the coordinated crawler 7. A possibly required swivelling or, respectively, lateral adjustment of the rail-removing device 4 is performed at the same time upon activation of the drives 27, 28 and 29 in order to align the crawler 7 and the coordinated counter support 8 in each case parallel to the longitudinal direction of the long rail to be removed and in order to assure a positioning of the rail head 25 between the wheel rims 24 of the double-track rim rollers 18.

In the following, the clamping hooks 34 are released, the drives 23 for pressing the double-track rim rollers 18 onto the long rail 3 and the first drives 11 for rotating the crawler 7 are activated. The fourth drive 28 and the fifth drive 29 are switched simultaneously to be pressureless. In order to remove, for example 120-meter-long rails, a press-on force of 32 tons is required for the double-track rim rollers 18 based on experience. The pull or removing force required for the removing of the long rails 3 amounts to about 8 tons. The removing force to be transferred by the contact plates 15 of the crawler 7 can be increased still further by a corresponding selection of the plate materials as well as the length of the crawler 7. The two rail-removing devices 4 are advantageously positioned at the further removed car end 102 relative to the hoisting winches 30 such that a corresponding bending line of the rails 3 can be formed between the transport car 2 and the rail-removing devices 4.

In a further sequence, the two long rails 3 are further transported, by actuating the two first drives 11, for example, on a track-laying train already known from the initially recited European printed patent document EP 0 467 001 B1, to the front end of the track-laying train. As soon as the rear ends of the two long rails, removed by the rail-removing devices 4 come to rest immediately in front of the crawlers 7 (cf. FIG. 1), then the removing action is stopped quickly. As a next step, two further long rails 3 are removed with the aid of a clamping hook 34 and the hoisting winches 30 from the transport car 2 in the manner already described until the front ends of these long rails 3 touch the rear ends of the previously removed long rails 3, already gripped by the two rail-removing devices 4. As soon as the two immediately neighboring ends of the successive long rails 3 are connected to each other by a fish plate connection 41, then the two clamping hooks 34 are disengaged and the removing of the extended long rails 3 is continued by means of the rail-removing devices 4 activated by the first drive 11 (FIGS. 1, 3). Thereby, parallel to the removing of the long rail 3 from the transport vehicle 2, also predisposed and previously removed long rails 3 are shifted in a length of about 500 meters on corresponding rail guides. As soon as the two rear ends of the long rails, removed from the transport vehicle 2, come to rest immediately in front of the two crawlers 7, then a connection of two further long rails 3 by means of a fish plate connection 41 is performed in the already described way and manner.

The described vehicle 1 with the rail-removing devices 4 can of course also be employed in connection with already known rail-laying trains (German printed patent document DE 12 08 326 B), recited above in the section "Background of the Present Invention", for the removing of the long rails transported to the construction site.

A further embodiment of a rail-removing device 4 is illustrated in FIG. 7, and the parts, having the same function, are designated for the purposes of simplicity with the same reference numerals as the embodiment shown in FIGS. 1 through 6. In the embodiment illustrated in FIG. 7, the counter support 8 is also formed as a crawler 42, wherein the crawler 42, if desired, can exhibit also its own drive for rotation. The upper crawler 42 contacts the head of the long rail 3 during the removing of the long rail 3, and the upper crawler 42 is pressed with the aid of the second drive 23 in the direction toward the lower crawler 7. For this purpose, the upper crawler 42 is supported shiftable in height level in a support frame 43, wherein the support frame 43 is attached swivelably around a horizontal axis 45, aligned perpendicular to the longitudinal direction of the vehicle carrying the rail-removing device. The support frame 43 swivels on a lower support frame 44, connected and attached to the car frame 6.

It will be understood that each of the elements described above, or two or more together, may also find a useful application in other types of rail-movable vehicles differing from the types described above.

While the invention has been illustrated and described as embodied in the context of a rail-movable vehicle with a rail-removing device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A rail-movable vehicle for removing long rails stored on a transport vehicle comprising undercarriages guided by rails;

a vehicle frame supported on the undercarriages guided by rails;

two deflection rollers mounted on the vehicle frame, wherein the two deflection rollers are disposed at a distance from each other, and wherein a rotation axis is associated with each deflection roller;

a crawler attached to the vehicle frame, and wherein the crawler is deflectable around two deflection rollers;

a drive attached to the vehicle frame, wherein the crawler is attached to the drive;

contact plates attached to the crawler and disposed in series in a removal direction for engaging with and for resting at the long rail;

a second drive attached to the frame;

a counter support adjustable by means of the second drive to be adjustably positioned relative to the crawler, and wherein the counter support is adapted to roll the long rail off, and wherein the deflection rollers, the crawler, the contact plates, the second drive, and the counter support form a rail-removing device for capturing, gripping, and shifting a long rail in a longitudinal direction of the rail-movable vehicle carrying the rail-removing device.

2. The rail-movable vehicle according to claim 1, wherein the rail-removing device is attached to the vehicle frame swivelable around a vertical axis.

3. The rail-movable vehicle according to claim 1, wherein the counter support is formed by at least two double-track rim rollers, disposed in series in the removal direction, wherein the double-track rim rollers have respective axes aligned parallel to the rotation axis of the deflection rollers, and wherein the counter support is positioned vertically above the crawler.

4. The rail-movable vehicle according to claim 1, wherein four double-track rim rollers are placed centered between the two rotation axes of the deflection rollers as seen in a vertical projection.

5. The rail-movable vehicle according to claim 1, further comprising a support attached to the vehicle frame, wherein the rail-removing device is attached to the support, wherein the support is formed extendible horizontally and perpendicular to the longitudinal direction of the vehicle carrying the rail-removing device for adjusting a lateral position of the rail-removing device.

6. The rail-movable vehicle according to claim 5, further comprising a fourth swivel drive attached to the frame, wherein the support is supported swivelable around a horizontal axle supported at the vehicle frame and aligned perpendicular to the longitudinal direction of the vehicle carrying the rail-removing device, and wherein the support is connected to the fourth swivel drive for swivelling the support around said horizontal axle.

7. The rail-movable vehicle according to claim 1, further comprising a hoisting winch disposed at an end of the rail-movable vehicle carrying the rail-removing device for feeding a long-rail;

a sixth drive attached to the vehicle frame;

a guide roller height-adjustable by the sixth drive for supporting the long rail.

8. The rail-movable vehicle according to claim 7, further comprising a second rail-removing device, wherein the first rail-removing device and the second rail-removing device are independent from each other and are disposed at an end of the rail-movable vehicle carrying the rail-removing device located remote relative to the hoisting winch.

9. A rail-movable car (1) for removing long rails (3), stored on a transport car (2), comprising a car frame (6), supported on undercarriages (5) guided by rails, and a rail-removing device (4) for capturing, gripping, and shifting a long rail (3) in a longitudinal direction of the car, wherein the rail-removing device (4) is formed of a crawler (7), wherein the crawler is furnished with a first drive (11), and wherein the crawler is deflectable around two deflection rollers (9), wherein the two deflection rollers (9) are disposed at a distance from each other, and wherein a rotation axis (10) is associated with each deflection roller (9), wherein contact plates (15) are disposed in series in the removal direction for engaging with and for resting at the long rail, a counter support (8) adjustable by means of a second drive (23) relative to the crawler, and wherein the counter support (8) is adapted to roll the long rail (3) off.

10. The rail-movable car according to claim 9, wherein the rail-removing device (4) is attached to the car frame (6) swivelable around a vertical axis (20).

11. The rail-movable car according to claim 9, wherein the counter support (8) is formed by at least two double-track rim rollers (18), wherein said two double-track rim rollers (18) are disposed in series in the removal direction, wherein the double-track rim rollers (18) have respective axes (19) aligned parallel to the rotation axis (10), and wherein the counter support (8) is positioned vertically above the crawler (7).

12. The rail-movable car according to claim 9, wherein four double-track rim rollers (18) are placed centered between the two rotation axes (10) of the crawler (7) as seen in a vertical projection.

13. The rail-movable car according to claim 9, wherein the rail-removing device (4) is attached to a support (26), wherein the support (26) can be formed extendible horizontally and perpendicular to the longitudinal direction of the car for adjusting a lateral position of the rail-removing device (4), and wherein the support (26) is attached at the car frame (6).

14. The rail-movable car according to claim 13, wherein the support (26) is supported swivelable around a horizontal axis (46) aligned perpendicular to a longitudinal direction of the car at the car frame (6), and wherein the support (26) is connected to a fourth swivel drive (28) for swivelling the support (26) around the horizontal axis (46).

15. The rail-movable car according to claim 9, wherein a hoisting winch (30) and a guide roller (32) are disposed at an end of the car for feeding new long rails (3), wherein the guide roller (32) is height-adjustable by a sixth drive (31) for supporting the long rail (3).

16. The rail-movable car according to claim 15, wherein two rail-removing devices (4), independent from each other, are disposed at an end of the car disposed remote relative to the hoisting winch (30).

* * * * *

UNITED STATES PATENT AND TRADEMARK OFFICE

CERTIFICATE OF CORRECTION

PATENT NO : 5,961,271

DATED : October 5, 1999

INVENTOR(S): Josef Theurer, Manfred Brunninger

It is certified that error appears in the above-identified patent and that said Letters Patent is hereby corrected as shown below:

On the title page, Foreign Application Priority Data [30]:

Change the name of the country of the foreign priority application to read:

[AU] Austria

Signed and Sealed this

Twenty-fourth Day of October, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. : 5,961,271

DATED : October 5, 1999

INVENTOR(S) : Josef Theurer, Manfred Brunningen

It is certified that error appears in the above-identified patent and that said Letters Patent is hereby corrected as shown below:

On the title page, Foreign Application Priority Data [30]:

Change the name of the country of the foreign priority application to read:

[AT] AUSTRIA

Signed and Sealed this

Nineteenth Day of December, 2000

*Attest:*

*Attesting Officer*

Q. TODD DICKINSON

*Commissioner of Patents and Trademarks*